US008170443B2

(12) United States Patent
Kawaguchi

(10) Patent No.: US 8,170,443 B2
(45) Date of Patent: May 1, 2012

(54) DEVELOPING DEVICE AND PROCESS CARTRIDGE

(75) Inventor: Daisuke Kawaguchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 397 days.

(21) Appl. No.: 12/581,489

(22) Filed: Oct. 19, 2009

(65) Prior Publication Data

US 2010/0129110 A1 May 27, 2010

(30) Foreign Application Priority Data

Nov. 26, 2008 (JP) ..... 2008-301213

(51) Int. Cl.
*G03G 15/08* (2006.01)

(52) U.S. Cl. ..... 399/104; 399/103; 399/256

(58) Field of Classification Search ..... 399/103, 399/104, 256
See application file for complete search history.

(56) References Cited

U.S. PATENT DOCUMENTS

| | | | | |
|---|---|---|---|---|
| 4,373,468 | A * | 2/1983 | Suda et al. | 399/103 |
| 5,267,007 | A | 11/1993 | Watanabe et al. | |
| 5,287,148 | A * | 2/1994 | Sakemi et al. | 399/104 |
| 5,450,169 | A * | 9/1995 | Hart et al. | 399/104 |
| 5,742,876 | A * | 4/1998 | Bogoshian | 399/104 |
| 6,104,894 | A | 8/2000 | Sato et al. | |
| 7,474,866 | B2 | 1/2009 | Doi et al. | |
| 2002/0172526 | A1 * | 11/2002 | Miyabe et al. | 399/104 |

FOREIGN PATENT DOCUMENTS

| | | | |
|---|---|---|---|
| JP | 3-251882 | A | 11/1991 |
| JP | 11-296051 | A | 10/1999 |
| JP | 2000-112228 | A | 4/2000 |
| JP | 2003-162146 | A | 6/2003 |

* cited by examiner

*Primary Examiner* — David Gray
*Assistant Examiner* — Francis Gray
(74) *Attorney, Agent, or Firm* — Fitzpatrick, Cella, Harper & Scinto

(57) ABSTRACT

A developing device for developing with a developer a latent image formed on an image bearing member includes a container for containing the developer; a stirring member, rotatably supported by the container, for stirring the developer in the container; a magnetic member for forming a magnetic field in a gap between the container and a rotation shaft located at an end portion of the stirring member so as to magnetically confine magnetic particles in the gap; a seal member, provided outside the magnetic member with respect to a rotation shaft direction of the stirring member, contacting a peripheral surface of the rotation shaft of the stirring member; and a non-magnetic preventing portion, provided between the magnetic member and the seal member, for preventing the magnetic particles confined by the magnetic member from spreading toward the seal member.

8 Claims, 10 Drawing Sheets

DEVELOPING DEVICE AND PROCESS CARTRIDGE

FIELD OF THE INVENTION AND RELATED ART

The present invention relates to a developing device used in an electrophotographic image forming apparatus or the like, such as a laser beam printer or a copying machine and relates to a process cartridge including the developing device.

In an image forming apparatus using electrophotography, when its operation time is increased, there arise needs for exchange of a photosensitive drum, supply and exchange of a developer, and adjustment, cleaning and exchange of other devices (such as a charging device and a cleaning device). It was difficult for persons; other than a service person with expertise, to perform a maintenance operation of such process means. In order to eliminate the difficulty, a process cartridge integrally including image forming means, as a cartridge, such as the photosensitive drum, the developing device, the cleaning device, or the like has been put into practical use. As a result, in the case where there arose the need for the maintenance of the process means, a user himself (herself) was able to easily perform the maintenance and the exchange, thus being able to obtain a high-quality image inexpensively and easily. Such a process cartridge is provided with, e.g., a stirring member a developer stirring device in a developer container as a developer accommodating portion and drives the stirring member by transmitting a driving force from the outside of the container through a gear or the like. In order to transmit the driving force to the stirring member, a wall of the developer container is provided with a through hole through which one end portion of the stirring member passes and is connected to the gear located outside the container. For that reason, there is a possibility of an occurrence of leakage of the developer (toner) from the through hole portion. In view of the possibility, the toner leakage has been conventionally prevented by mounting a seal member having a lip portion contacting a full circumferential surface of a shaft of the stirring member (a portion contacting the shaft at an inner peripheral portion of a ring-like seal member) to the developer container.

However, in recent years, the image forming apparatus further improved in productivity and space saving has been required than ever. Also in the process cartridge, in order to meet a high-speed image forming process, the stirring member has been rotated at a speed higher than an conventional speed. Further, not only downsizing of the image forming apparatus but also downsizing of the process cartridge have been required. In order to downsize the process cartridge, a decrease in outer diameter of the above-described stirring member is effective. However, when the outer diameter of the stirring member is decreased, stirring and feeding properties with respect to the developer are lowered. In order to prevent the lowering in stirring and feeding properties, it is necessary to compensate for the lowered stirring and feeding properties by increasing the number of rotation of the stirring member. Thus, in recent years, the stirring member in the process cartridge has been rotated at a still higher speed than the conventional speed. However, when the stirring member is rotated at the high speed, the lip portion of the stirring member is abraded in a short time, so that a sealing property cannot be maintained. As described above, the image forming apparatus required to achieve the high productivity is simultaneously required to achieve a high durability in many cases, so that it becomes difficult to satisfy the required durability by the above-described contact-type seal member alone.

On the other hand, a sealing constituting using a magnet has also been known. In this constitution, a ring-like magnet (ring magnet) is provided by being passed through an end portion of the stirring member. A shaft portion of the stirring member facing an inner peripheral surface of the ring magnet is formed with a magnetic member to generate a magnetic field in a gap between the shaft portion of the stirring member and the ring magnet. The gap is filled with a magnetic developer by collecting the magnetic developer in the gap, thus performing sealing. However, even in the case of such magnetic sealing, when the number of rotation of the stirring member is increased, there arises a problem that toner contained in the developer is melted by frictional heat generated between the collected developer and the shaft portion of the stirring member and then is solidified again to cause locking of the stirring member. In order to solve this problem, weakening of a magnetic force of the magnetic is effective but simultaneously causes a lowering in sealing property, so that it is also difficult to satisfy the required durability.

In order to ensure the sealing property more reliably, a sealing constitution employing a magnetic sealing using a magnetic in combination with the seal member having the lip portion has been proposed (e.g., Japanese Laid-Open Patent Application (JP-A) Hei 11-296051).

However, in the case where the sealing is performed by using both of the magnetic member and the seal member as in JP-A Hei 11-296051, when the magnetic member and the seal member are provided adjacently to each other in order to downsize a developing device, the following problem arises. That is, an end of the lip portion of the seal member is buried in the collected magnetic powder (developer) and receives pressure from the magnetic powder which is about to be restored with respect to a direction along magnetic lines of force. In this case, a force by which the toner enters between the lip portion end and an outer peripheral surface (sealing surface) of a shaft member is increased. When the toner once enters between the lip portion end and the outer peripheral surface (sealing surface) of the shaft member, the toner acts like an abrading material in a gap created between the lip portion of the seal member fixed to the toner container and the outer peripheral surface of the shaft member which is in rotational motion, so that abrasion of the lip portion end is accelerated. When the abrasion of the lip portion end progresses, the lip portion end cannot retain a contact state with the outer peripheral surface of the shaft member, so that the toner leaks out of the created gap and reaches a shaft-supporting portion. In the case of a sliding shaft-supporting member, the toner melted by heat generated due to friction between the shaft member and the shaft-supporting member is solidified again, so that the stirring member is locked. In the case of a rolling ball shaft-supporting member (bearing), the toner enters the bearing, so that locking of the bearing is also caused to occur. In order to solve the above-described problem, it is considered that the lip portion of the seal member is disposed at a position in which the lip portion does not receive pressure from the magnetic powder collected by the magnetic member or is disposed so that the magnetic member and the seal member are spaced apart from each other with a distance such that an influence therebetween is negligible. However, a space with respect to a shaft direction of the stirring member is required correspondingly to the distance (gap) between the magnetic member and the seal member, so that elongation and increasing in size of a unit are caused to occur.

SUMMARY OF THE INVENTION

A principal object of the present invention is to provide a developing device capable of suppressing abrasion of an end of a seal member by magnetic powder collected by a magnetic member even when the magnetic member and the seal member are disposed closely to each other in order to realize downsizing of the developing device.

According to an aspect of the present invention, there is provided a developing device for developing with a developer a latent image formed on an image bearing member, the developing device comprising:

a container for containing the developer;

a stirring member, rotatably supported by the container, for stirring the developer in the container;

a magnetic member for forming a magnetic field in a gap between the container and a rotation shaft located at an end portion of the stirring member so as to magnetically confine magnetic particles in the gap;

a seal member, provided outside the magnetic member with respect to a rotation shaft direction of the stirring member, contacting a peripheral surface of the rotation shaft of the stirring member; and a non-magnetic preventing portion, provided between the magnetic member and the seal member, for preventing the magnetic particles confined by the magnetic member from spreading toward the seal member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the present invention will be described with reference to the drawings. Incidentally, it should be understood that dimensions, materials, shapes, relative positions, and the like of constituent elements of a developing device are not limited to those in the following embodiments unless otherwise specified.

<Embodiment 1>

Figure 1:
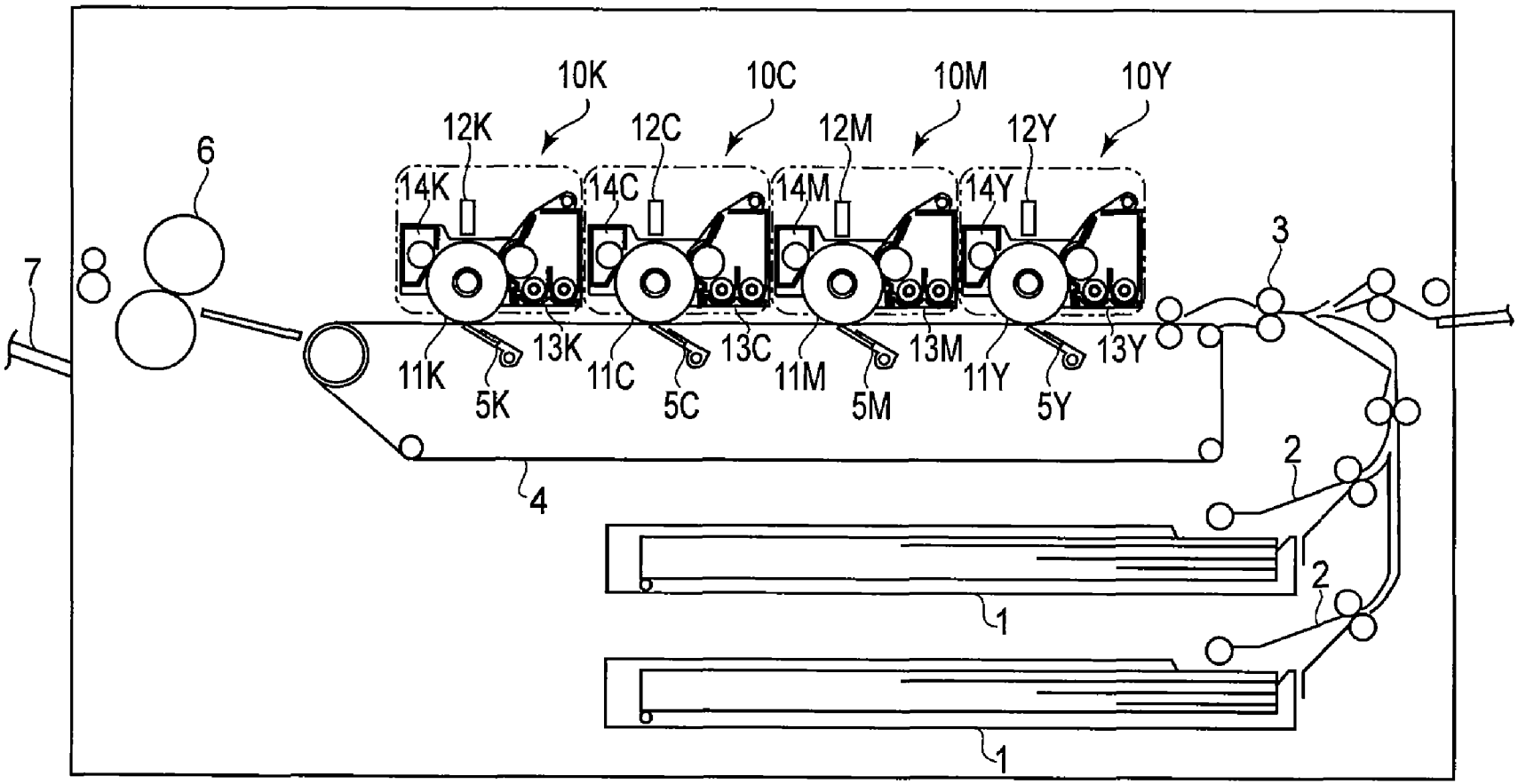
FIG. 1 is a schematic view of an image forming apparatus (a full-color copying machine) in the present invention.

FIG. 1 shows a cross section of a full-color copying machine, as an image forming apparatus in the present invention, which is an apparatus for forming a full-color toner image by superposing toner images of four colors of yellow, magenta, cyan and black.

Figure 2:
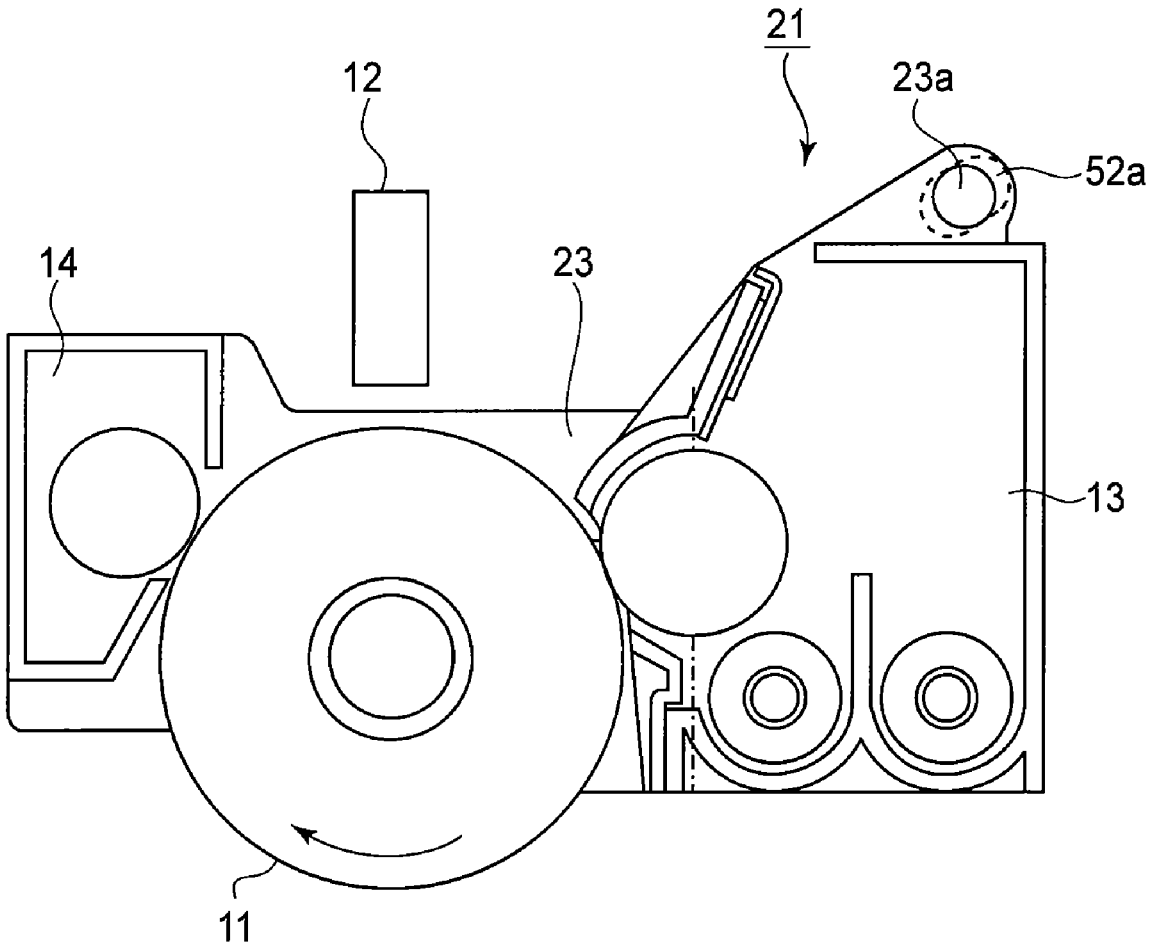
FIG. 2 is a schematic view of an image forming portion of the image forming apparatus in the present invention.

In FIG. 1, reference symbols 10Y, 10M, 10C and 10K represent image forming portions (stations) for yellow, magenta, cyan and black, respectively. FIG. 2 is an enlarged view showing the image forming portion corresponding to one station.

Recording paper accommodated in a cassette 1 reaches, after being fed by a sheet feeding portion 2, registration rollers 3 by which oblique movement or the like of the recording paper is corrected, and then is sent toward a transfer belt 4 with appropriate timing. During this period, in accordance with an image information signal sent from an unshown image reading device or an output device (not shown) of a computer, latent images for respective color toner images are formed on photosensitive drums 11Y, 11M, 11C and 11K, respectively, as an image bearing member.

On the other hand, the recording paper sent from the registration rollers 3 is electrostatically attracted on (adsorbed by) the transfer belt 4 by which the recording paper is conveyed while passing under the respective color image forming portions 10Y, 10M, 10C and 10K.

At the respective image forming portions 10Y, 10M, 10C and 10K, exposure LED heads 12Y, 12M, 12C and 12K are disposed around the photosensitive drums 11Y, 11M, 11C and 11K, respectively. Further, around the photosensitive drums 11Y, 11M, 11C and 11K, developing devices 13Y, 13M, 13C and 13K and injection charging devices 14Y, 14M, 14C and 14K are disposed. The respective color toner images are formed on the surfaces of the photosensitive drums 11Y, 11M, 11C and 11K by an electrophotographic process. That is, the surfaces of the photosensitive drums 11Y, 11M, 11C and 11K are electrically charged to a predetermined potential by the injection charging devices 14Y, 14M, 14C and 14K. The charged surfaces of the photosensitive drums 11Y, 11M, 11C and 11K are exposed to light by the exposure LED heads 12Y, 12M, 12C and 12K, so that latent images are formed on the photosensitive drums 11Y, 11M, 11C and 11K. The latent images formed on the photosensitive drums 11Y, 11M, 11C and 11K are developed by the developing devices 13Y, 13M, 13C and 13K, so that the respective color toner images are formed.

Then, the respective color toner images are successively transferred onto the recording paper by the action of transfer means 5Y, 5M, 5C and 5K at transfer portions where the transfer belt comes close to the photosensitive drums 11Y, 11M, 11C and 11K.

The recording paper on which the four color toner images are transferred is separated from the transfer belt 4 by curvature and is conveyed to a fixing portion 6. The recording paper is heated and pressed at the fixing portion 6, so that the toner images are fixed on the recording paper. Thereafter, the recording paper is discharged on a sheet discharge tray 7, so that a copying operation is completed.

Figure 3:
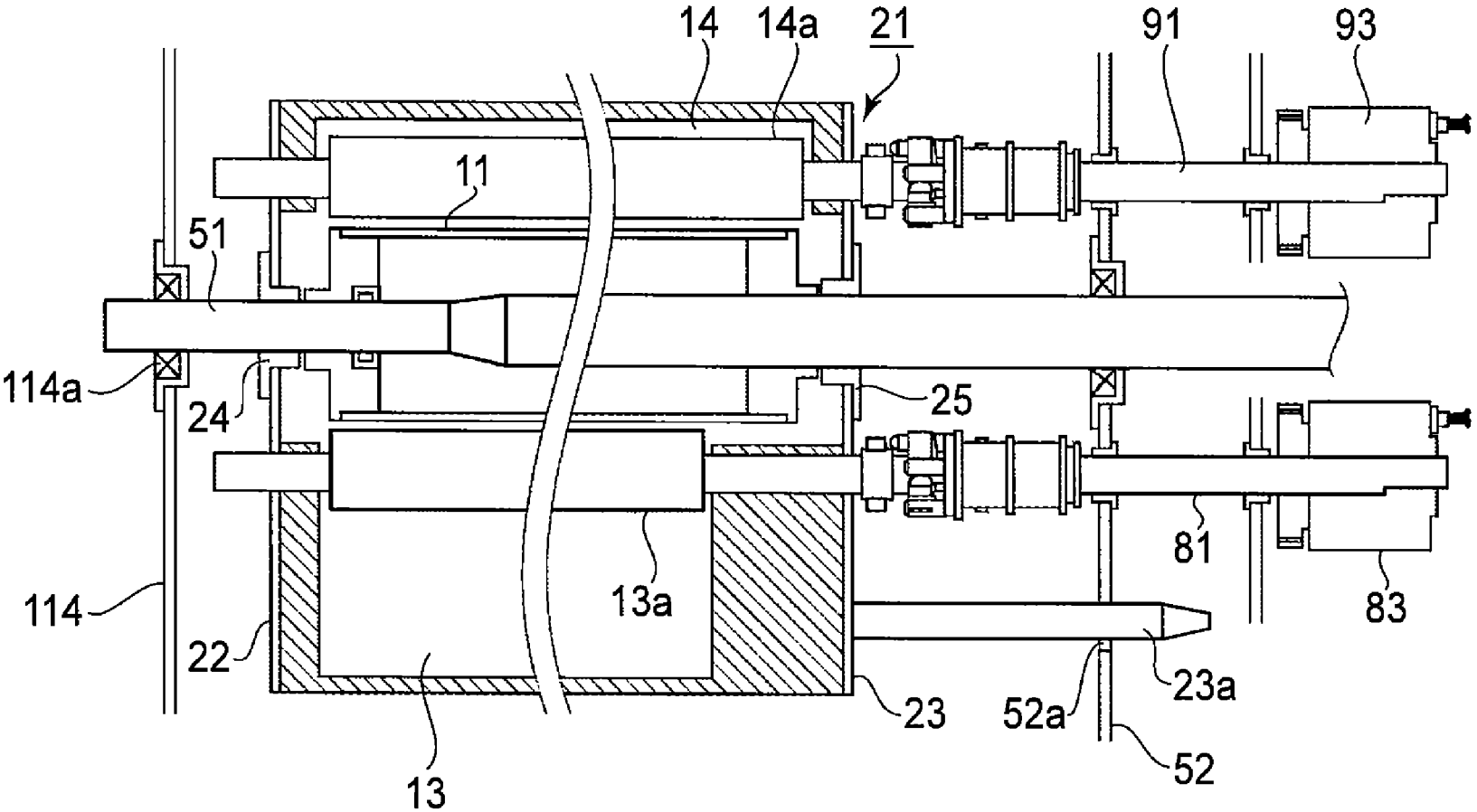
FIG. 3 is a longitudinal sectional view of the image forming portion and a driving system of the image forming apparatus in the present invention.

Next, a process cartridge 21 will be described with reference to FIGS. 2 and 3. FIG. 3 is a longitudinal schematic view showing a constitution of the process cartridge 21 and its driving system.

The process cartridge 21 is constituted by the photosensitive drum 11, the developing device 13, and the injection charging device 14 which are integrally supported through kit side plates 22 and 23 as shown in FIG. 3. The process cartridge 21 is constituted so as to be detachably mountable to a main assembly of the image forming apparatus with respect to a front-rear direction, so that integral exchange thereof or partial exchange or maintenance thereof can be performed.

The photosensitive drum 11 is not positioned to the kit side plates 22 and 23 but is positioned by being engaged with a drum shaft 51 when the photosensitive drum 11 is mounted in the apparatus main assembly. On the other hand, the developing device 13 and the injection charging device 14 are fixed to the kit side plates 22 and 23. Shaft supporting portions 24 and 25 of the kit side plates 22 and 23 are engaged with the drum shaft 51 and further a pin 23*a* projected from the kit side plate 23 is engaged in a minor diameter portion of an elongated hole portion 52*a* provided to a main assembly side plate 52, so that positioning among the kit side plates 22 and 23, the developing device 13, and the injection charging device 14 is performed.

A developing sleeve 13*a* of the developing device 13 and an injection sleeve 14*a* of the injection charging device 14 are assembled to the kit side plates 22 and 23 after a distance between the shaft supporting portion 24 and each of the sleeves 13*a* and 14*a* and a distance between the shaft supporting portion 25 and each of the sleeves 13*a* and 14*a* are adjusted with high precision. As a result, the developing sleeve 13*a* and the injection sleeve 14*a* are positioned to the drum shaft 51 with respect to a radial direction with high precision when the process cartridge 21 is mounted in the apparatus main assembly. Further, the photosensitive drum 11 is also positioned to the drum shaft 51, so that a clearance (SD gap) between the photosensitive drum 11 surface and each of the developing sleeve 13*a* and the injection sleeve 14*a* is set with high precision.

Driving shafts 81 and 91 shown in FIG. 3 are shafts for driving the developing sleeve 13*a* and the injection sleeve 14*a*, respectively, and are provided co-axially with the developing sleeve 13*a* and the injection sleeve 14*a*, respectively. To these driving shafts 81 and 91, electromagnetic clutches 83 and 93 are provided, respectively, and are rotatable with predetermined timing. Ends of the developing sleeve 13*a* and the driving shaft 81 and ends of the injection sleeve 14*a* and the driving shaft 91 are connected by couplings 61 and 71, respectively. Though the couplings 61 and 71, driving forces are transmitted from the driving shafts 81 and 91 to the developing sleeve 13*a* and the injection sleeve 14*a*, respectively.

Figure 4:
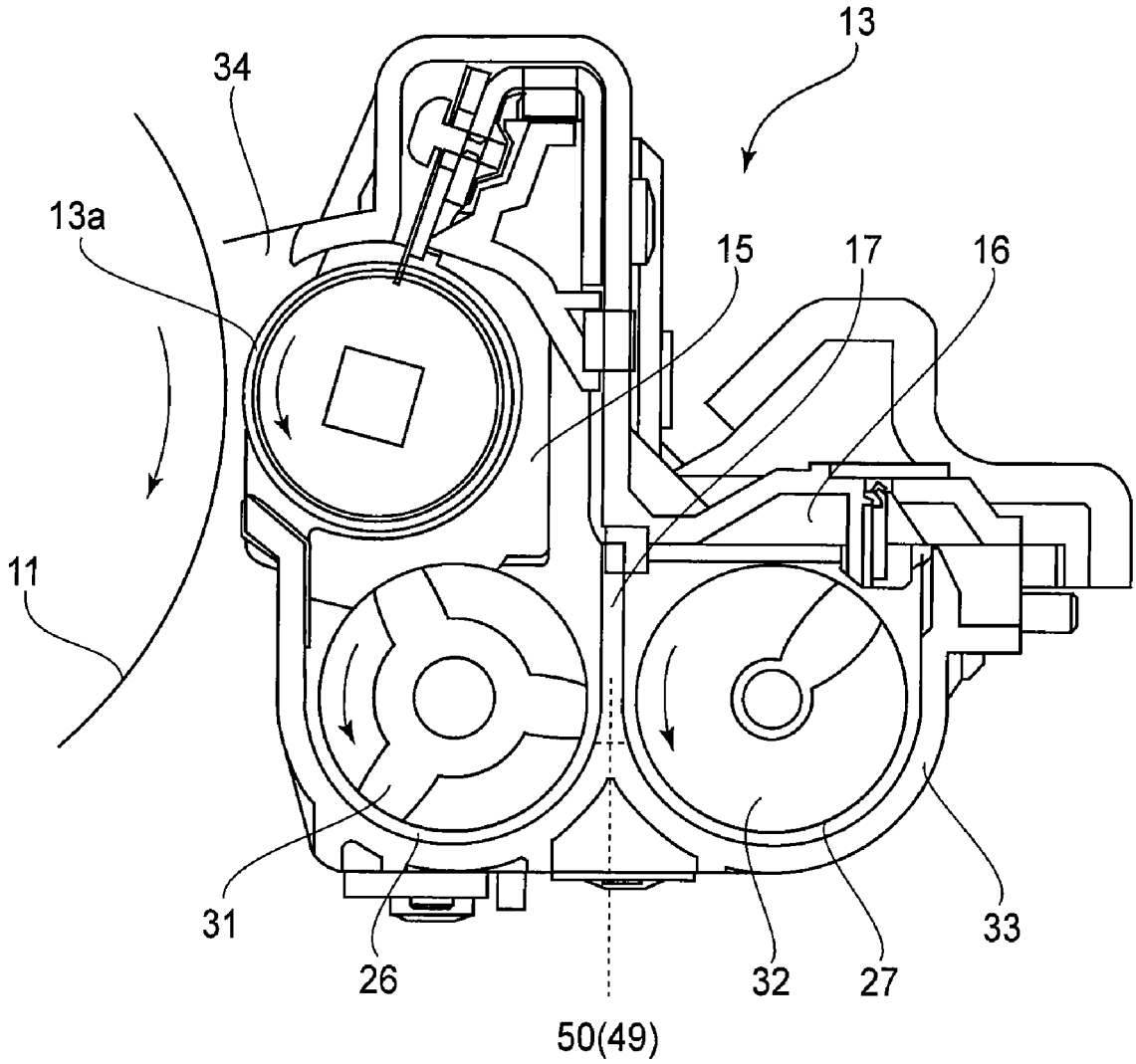
FIG. 4 is a schematic view showing a constitution of a developing device according to Embodiment 1 of the present invention.
Figure 5:
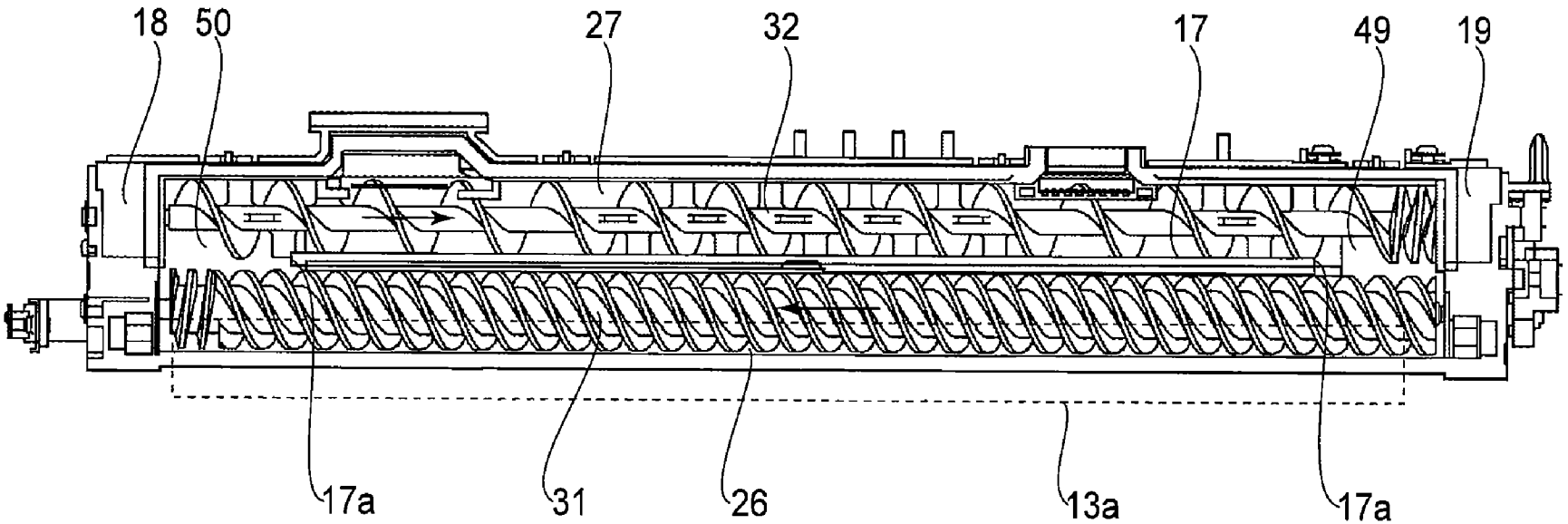
FIG. 5 is a longitudinal schematic view showing the developing device according to Embodiment 1 of the present invention as seen from above.

Next, with reference to FIGS. 4 and 5, a constitution of the developing device 13 will be described in detail.

In this embodiment, the developing device 13 includes a housing 33 as a developing container for containing the developer. The housing 33 is located oppositely to the photosensitive drum 11 as an image bearing member through an opening 34, at which the developing sleeve 13*a* as a developer carrying member is rotatably disposed. The housing 33 includes a developing chamber disposed closely to the developing sleeve 13*a* and a stirring chamber 16 disposed apart from the developing sleeve 13*a*. The developing chamber 15 and the stirring chamber 16 are partitioned by a partition wall 17. In a first feeding path 26 formed in the developing chamber provided in the developing container, a front-side stirring shaft, i.e., a first developer stirring member 31 is disposed in substantially parallel to a shaft line of the developing sleeve 13*a*. In a second feeding path 27 formed in the stirring chamber 16, a rear-side stirring shaft, i.e., a second developer stirring member 32 is disposed in substantially parallel to the shaft line of the developing sleeve 13*a*. These two (first and second) stirring members 31 and 32 circulatively feed the developer while stirring the developer in the developing chamber 15 and the stirring chamber 16, i.e., the first feeding path 26 and the second feeding path 27, respectively. Referring to FIG. 5, the partition wall 17 for partitioning the developing chamber 15 and the stirring chamber 16 is formed therebetween, i.e., between the first feeding path 26 and the second feeding path 27. Between an end 17*a* of the partition wall 17 and an opposite side wall 18 of the housing 33 and between an end 17*b* of the partition wall 17 and an opposite side wall 19 of the housing 33, a first opening 50 and a second opening 49 are provided, respectively. The first opening 50 has the function of transferring the developer from the first feeding path 26 to the second feeding path 27, and the second opening 49 has the function of transferring the developer from the second feeding path 27 to the first feeding path 26. Therefore, the partition wall 17 is formed so that only the portions of the first and second feeding paths 26 and 27 close to the both ends 17*a* and 17*b* permit communication between the first feeding path 26 and the second feeding path 27 through the first opening 50 and the second opening 49. Other portions of the first and second feeding paths 26 and 27 form mutually isolated circulating paths of the developer. The developer is circulated in a direction of indicated arrows in FIG. 5 while being stirred. In the developing device shown in FIG. 5, the first developer stirring member 31 is a multiple-threaded screw member which is a triple-threaded screw member in this embodiment. The second developer stirring member 32 is a single-threaded screw member. Further, the first developer stirring member 31 and the second developer stirring member 32 are, as described above, disposed in the first feeding path 26 and the second feeding path 27, respectively, so as to feed the developer in opposite directions.

Figure 6:
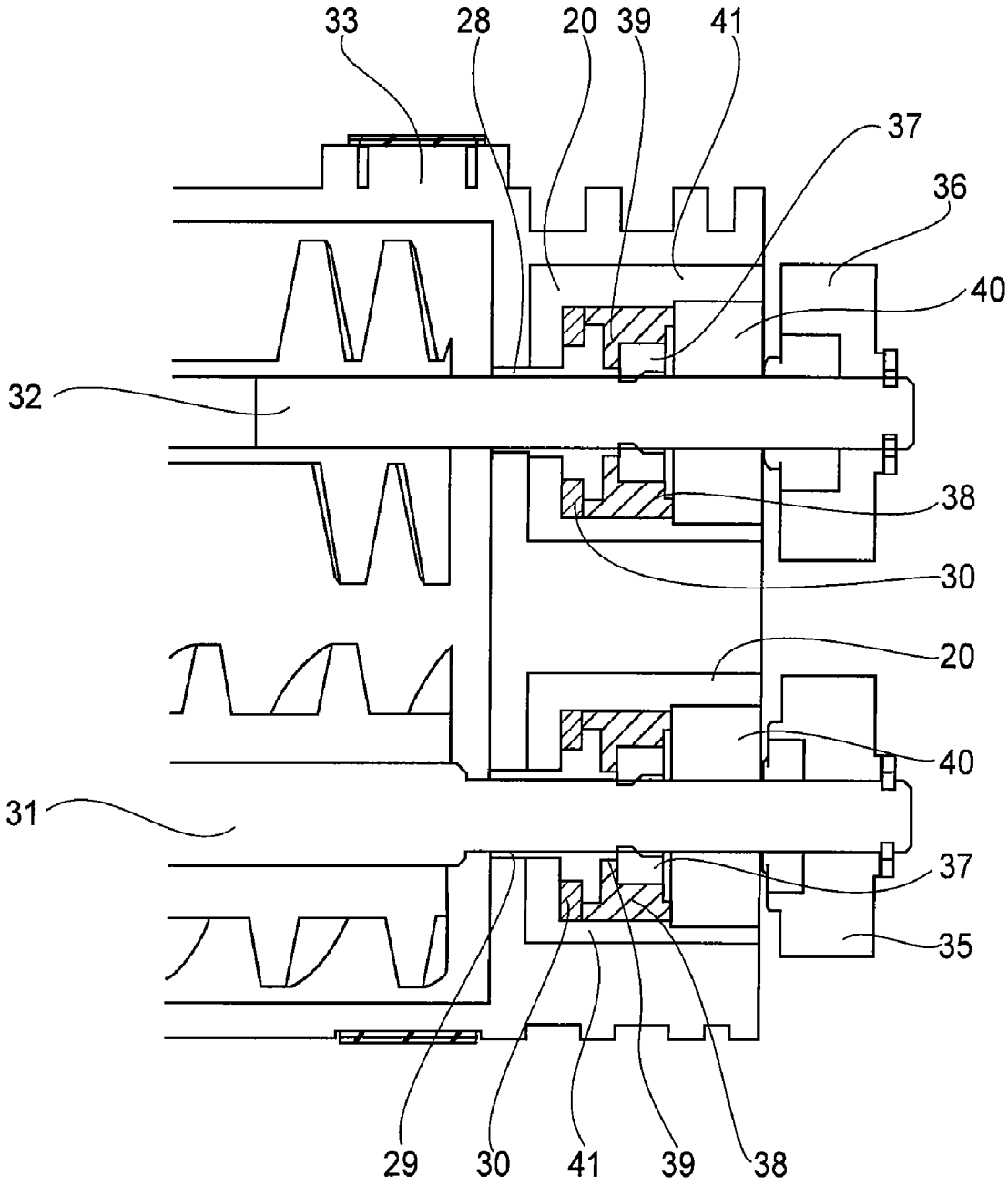
FIG. 6 is a schematic view showing an end portion sealing constitution of a stirring member in Embodiment 1 of the present invention.
Figure 7:
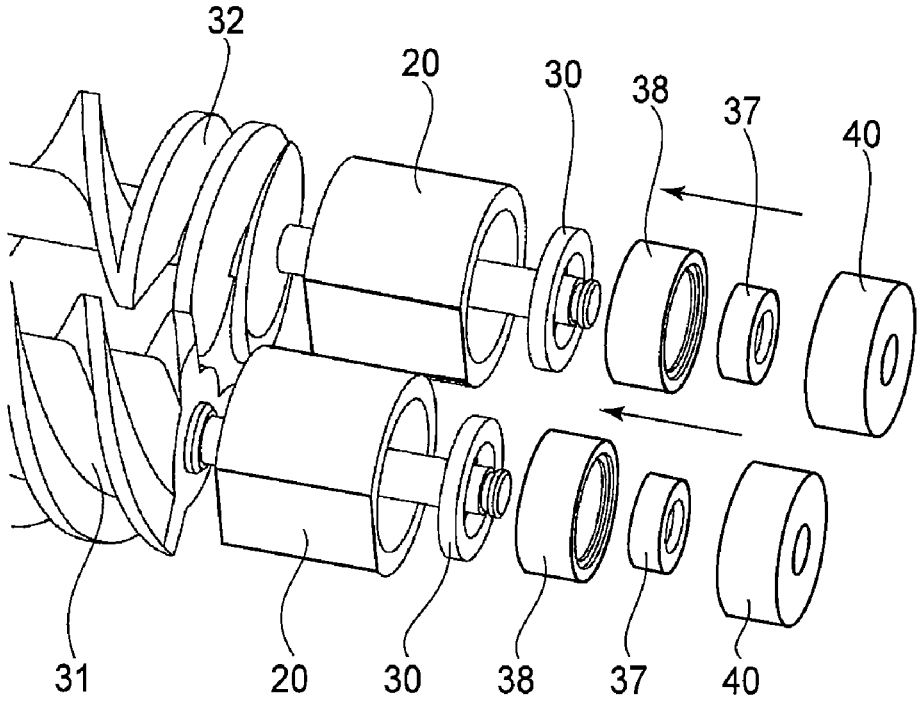
FIG. 7 is an exploded view showing the end portion sealing constitution of the stirring member in Embodiment 1 of the present invention.

FIG. 6 is an enlarged schematic view showing one end portions of the first and second developer stirring members 31 and 32 and the wall 19 (FIG. 5) of the housing 33. In FIG. 6, hatched portions represent cross-sections of ring magnets 30 and contact seal holders 38 which are described later. FIG. 7 is an exploded perspective view showing members, described later, for constituting the first and second developer stirring members 31 and 32 and a seal unit 41 (FIG. 6). These members are assembled with respect to an indicated arrow direction in FIG. 7.

As shown in FIG. 6, the first and second developer stirring member 31 and 32 pass through through holes 28 and 29 provided to the wall 19 and project to the outside of the housing 33 at their one shaft end portions. The first and second developer stirring members 31 and 32 are formed by integrally molding a resin material such as ABS in a helical screw shape around a core metal. The core metal is formed of magnetic metal such as iron which has been smoothly surface-finished with KN (chemical nickel) plating or the like, and has a surface roughness (Rz) of 0.8 μm or less in this embodiment. At the shaft end portions of the first and second developer stirring members 31 and 32, driving gears 35 and 36 for transmitting a driving force to the first and second developer stirring members 31 and 32, respectively, are fixed. The driving gears 35 and 36 engage with unshown idler gears provided to the developing device 13 and are subjected to the driving force transmission from the driving shaft 81 (FIG. 3), so that the first and second developer stirring members 31 and 32 are driven in interrelation with each other. Further, the ring magnet 30, the contact seal member 37, the contact seal holder 38, and a bearing 40 are co-axially assembled in a seal housing 20 to constitute the seal unit 41. The contact seal member 37 is disposed outside the ring magnet 30 with respect to the rotation shaft direction of the first and second developer stirring members 31 and 32 of the developing container. The seal unit 41 is engaged with a cylindrical portion provided to the housing 33 and is thus fixed to the housing 33 so that the ring magnet 30, the contact seal member 37 and the bearing 40 are disposed co-axially with the associated first or second developer stirring member 31 or 32 is shaft-supported by the bearing 40 provided as a shaft supporting portion to the housing 33.

The contact seal member 37 is formed with an elastic member such as a nitrile rubber or the like and is provided with a lip portion (contact portion) which contacts a circumferential shaft surface of a seal portion of the associated first or second developer stirring member 31 or 32. By linear contact between the lip portions and the associated seal portions of the first and second developer stirring members 31 and 32, inclusion of the toner therebetween is prevented. A cylindrical surface of the contact seal holder 38 in which the contact seal member 37 is engaged has a diameter larger than that of an outer peripheral surface of the contact seal member 37 by about several tens of microns. The contact seal member 37 and the contact seal holder 38 are fixed to each other by press-fitting engagement. Each of the ring magnet 30 and the contact seal holder 38 in which the contact seal member 37 is assembled is engaged and positioned at a cylindrical (inner) surface of the seal housing 20.

The contact seal holder 38 is provided with a projection projected toward the ring magnet 30. The projection runs against the ring magnet 30, so that a relative position between the ring magnet 30 and the contact seal member 37 is regulated. Further, by the projection, a space in which the developer is accommodatable between the ring magnet 30 and the contact seal member 37 is formed with respect to each of the shaft line directions of the first and second developer stirring members 31 and 32. By this space, the developer is temporarily accommodatable even when the developer confined by the ring magnet 30 leaks toward the contact seal member side.

A position of the seal unit 41 with respect to the shaft direction is regulated by regulating the end surface of the bearing 40 by each of the end surfaces of the driving gears 35 and 36 positions of which with respect to the shaft direction are regulated with an associated E-shaped metal member. The ring magnet 30 is disposed oppositely to the peripheral shaft surface of the associated first or second developer stirring member 31 or 32 with a predetermined gap. At a position where the inner peripheral surface of the ring magnet 30 and the core metal of the associated first or second developer stirring member 31 or 32 oppose each other, a magnetic field is formed therebetween. The magnetic developer is magnetically confined by the magnetic field generated from the ring magnet 30, thus being prevented from leaking out to the outside of the housing 33 through the associated through hole 28 or 29. Each of inner diameters of the through holes 28 and 29 and the through holes provided in the seal housings 20 is set to be smaller than an inner diameter of the ring magnet 30, so that a wall surface is formed with respect to the developer collected at the inner peripheral surface of the ring magnet 30. For example, in this embodiment, the inner diameter of the ring magnet 30 is 6.8 mm and on the other hand, the inner diameters of the through holes 28 and 29 and the through holes provided to the seal housings 20 are 5 mm. This is because the magnetic developer as magnetic particles collected at the inner peripheral surface of the ring magnet 30 can be prevented from erecting and spreading along the magnetic lines of force. As a result, the developer collected by the ring magnet 30 can be concentrated at the position in which the core metal and the inner peripheral surface of the ring magnet 30 oppose each other, so that the sealing property of the magnetic sealing can be improved. On the other hand, with respect to the rotation shaft line direction of the stirring member, a wall portion 39 as a preventing portion is provided between the ring magnet 30 and the contact seal member 37. The wall portion 39 in the present invention is formed with a non-magnetic member so as not to attract the magnetic developer collected by the magnetic lines of force of the ring magnet 30. In this embodiment, the wall portion 39 is formed integrally with the contact seal holder 38.

The wall portion 39 prevents, as described above, the developer collected by the ring magnet 30 from erecting along the magnetic lines of force and preventing the magnetic particles from spreading toward the outside of the developing container with respect to the rotation shaft line direction. As a result, pressure application to the lip portion of the contact seal member 37 by the contact of the magnetic particles with the lip portion is prevented.

Thus, even when the ring magnet 30 and the contact seal member 37 are provided adjacently to each other, a force for causing the developer collected by the ring magnet 30 to enter between the contact seal member 37 and the associated first or second stirring member 31 or 32 is reduced. As a result, durability of the contact seal member 37 is improved.

Figure 11:
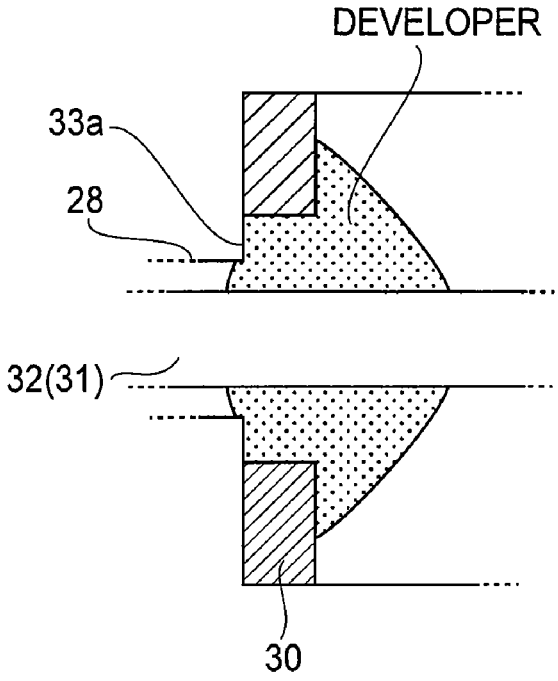
FIG. 11 is a schematic view showing a magnetic developer collected by a ring magnet.
Figure 12:
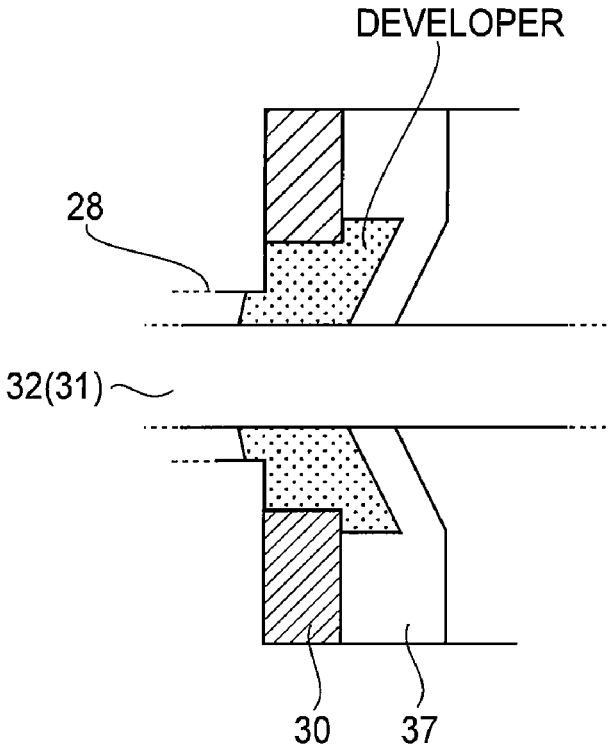
FIG. 12 is a schematic view in the case where the ring magnet and a contact seal member are disposed closely to each other.
Figure 13:
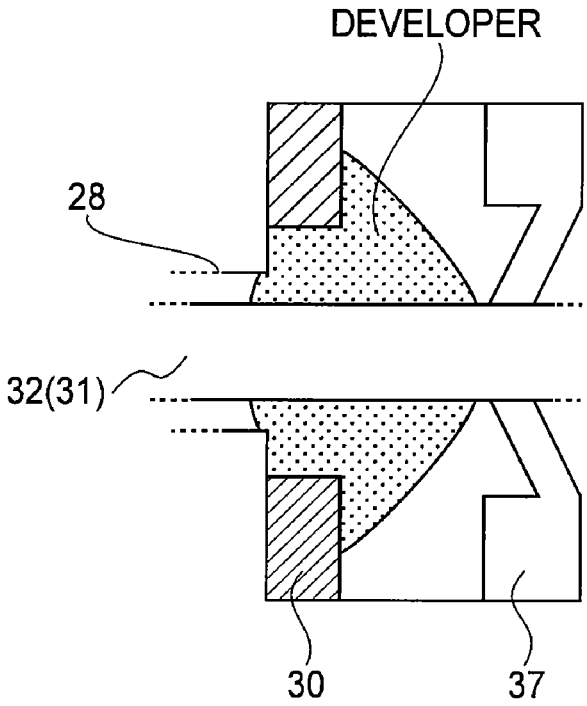
FIG. 13 is a schematic view in the case where the ring magnet and the contact seal member are disposed with a distance (spacing) therebetween.
Figure 14:
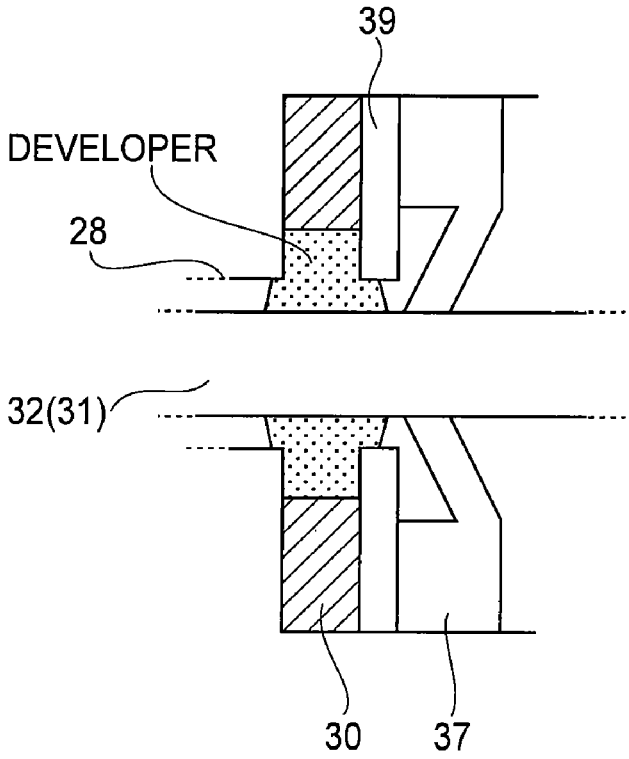
FIG. 14 is a schematic view showing the end portion sealing constitution in Embodiment 1 of the present invention.

An effect of the wall portion 39 will be described with reference to FIGS. 11 to 14. FIG. 11 shows a state in which the magnetic developer is collected by the ring magnet 30 under a condition that the wall portion 39 and the contact seal member 37 are removed. As shown in FIG. 11, the magnetic developer collected by the ring magnet 30 fills the gap between the ring magnet 30 and the core metal of the associated first or second stirring member 31 or 32, so that the developer in the housing 33 is prevented from leaking out of the housing 33. The collected developer agglomerates along the magnetic lines of force formed between the ring magnet 30 and the core metal of the associated first or second stirring member 31 or 32. For this reason, on a side in which there is no means (member) for preventing the agglomeration, such as a side in which a wall surface 33*a* of the housing 33 is not present, the developer is held in a state in which the developer considerably spread in the shaft line direction. Next, as shown in FIG. 12, the case where the ring magnet 30 and the contact seal member 37 are provided adjacently to each other will be considered. In this case, the neighborhood of the lip portion of the contact seal member 37 contacting the core metal is in a state in which it is filled with the magnetic developer collected by the ring magnet 30. In this state, the neighborhood of the lip portion receives a pressure from the magnetic developer liable to be restored with respect to the above-described direction of the magnetic lines of force. This pressure is a force exerted in a direction in which the magnetic developer is liable to enter between the core metal and the lip portion of the contact seal member 37, so that the entrance of the developer is accelerated. When the developer enters the lip portion, the particles of the developer function like an abrading material between the lip portion and the core metal, so that abrasion of the lip portion is accelerated. As a result, the durability of the contact seal member 37 is lowered. As one of means for avoiding the lowering in durability, as shown in FIG. 13, the contact seal member 37 may be moved away from the area in which the magnetic developer collected by the ring magnet 30 spreads but there arises such a problem that a larger disposing space for the contact seal member 37 is needed. Therefore, as shown in FIG. 14, in this embodiment, the wall portion 39 is provided between the ring magnet 30 and the contact seal member 37 to prevent the movement of the magnetic developer collected by the ring magnet 30. Thus, it is possible to not only prevent the movement of the magnetic developer to the lip portion of the contact seal member 37 but also dispose the ring magnet 30 and the contact seal member 37 closely to each other, thereby to realize space saving.

As described above, according to this embodiment, even when the constitution in which the ring magnet 30 and the contact seal member 37 are brought near to each other is employed, interference of the magnetic developer confined by the ring magnet 30 with the contact seal member 37 can be suppressed.

A larger effect of the wall portion 39 can be expected with a smaller gap between the wall portion 39 and the core metal of the associated first or second developer stirring member 31 or 32. The gap is set at 0.5 mm in this embodiment. That is, the following relationship is satisfied. With respect to a radial direction of each of the rotation shafts of the first and second developer stirring members 31 and 32, the gap between the wall portion 39 and the core metal of each of the first and second developer stirring members 31 and 32 is smaller than the gap between the ring magnet 30 and the core metal of each of the first and second developer stirring members 31 and 32.

The above-described ring magnet 30 is adjusted in magnetic force so as not to cause the locking by the toner melted at the magnetic sealing portion even when the first and second developer stirring members 31 and 32 are rotated at a high speed for a long time. For example, in this embodiment, a peak value of magnetic flux density at a center of the inner circumferential surface of the ring magnet 30 is set at 40 to 45 mT.

As described above, by juxtaposing the magnetic seal member constituted by the ring magnet 30 and the contact seal member 37, good durability is obtained through respective sealing effects of the magnetic seal member and the contact seal member 37 even in the case where the stirring members are rotated at high speeds. In addition, by providing the wall portion 39 between the ring magnet 30 and the contact seal member 37, it is possible to prevent the lowering in durability of the contact seal member 37 due to the influence of the developer collected by the magnetic seal member.

Incidentally, in this embodiment, the case where the core metals of the first and second developer stirring members 31 and 32 are constituted by the magnetic metal is described but the present invention is not limited thereto. For example, it is also possible to employ a constitution in which the core metal portion is also constituted by the resin material and is molded integrally with a sleeve member formed of the magnetic metal at a position where the core metal opposes the ring magnet 30 to form the magnetic field between the ring magnet 30 and the core metal.

In this embodiment, one side of each of the first and second developer stirring members 31 and 32 is described, it is possible to apply a similar sealing constitution to also the other side of each of the first and second developer stirring members 31 and 32.

Further, in this embodiment, the developer sealing constitution is described by taking the developing device as an example but the present invention is also suitably applicable to other units of the image forming apparatus. For example, the sealing constitution is also applicable to the injection charging device, a cleaning unit, collected toner feeding unit, a toner supply unit, and the like.

<Embodiment 2>

Figure 8:
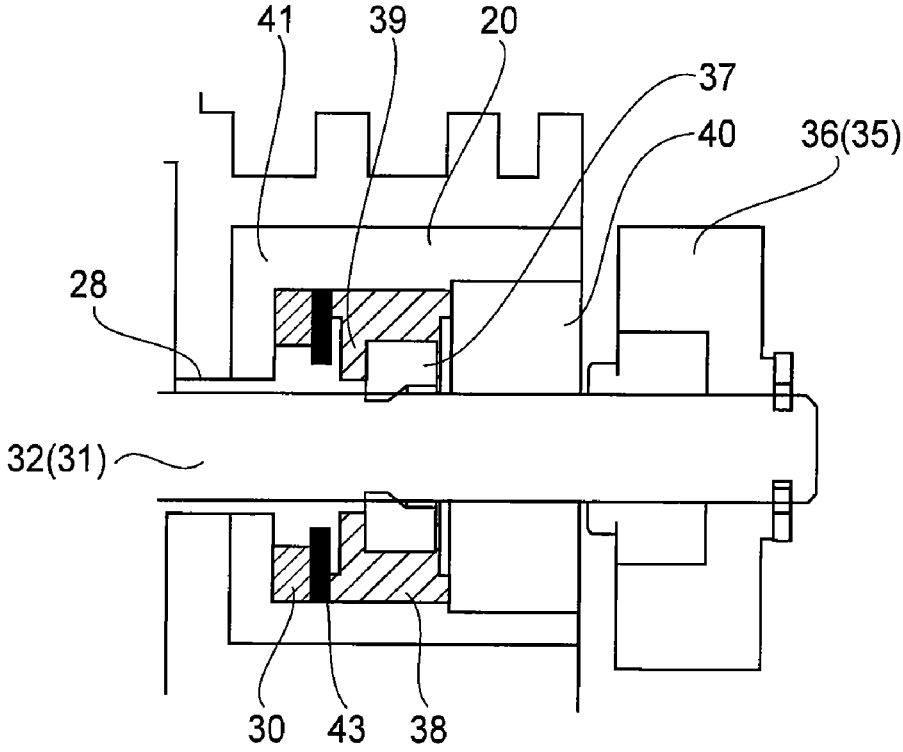
FIGS. 8, 9 and 10 are schematic views showing end portion sealing constitutions of stirring members in Embodiments 2, 3 and 4, respectively, of the present invention.

FIG. 8 is an enlarged schematic view of a seal unit 41 in Embodiment 2. In this embodiment, between the ring magnet 30 and the contact seal holder 38, a shielding plate 43 is provided. A constitution of this embodiment is identical to that of Embodiment 1 except that the shielding plate 43 is provided, thus being omitted from redundant description. The shielding plate 43 is a disk-like plate material and has a doughnut-like shape provided with a central circular hole concentrically with an outer peripheral circle. The shielding plate 43 is formed of a magnetic metal plate such as SPCC or SECC. The shielding plate 43 has an inner diameter set at a value smaller than that of the ring magnet 30. For example, in this embodiment, the inner diameter of the ring magnet 30 is 6.8 mm, whereas the inner diameter of the shielding plate 43 is 5 mm. The shielding plate 43 is constituted by the magnetic metal plate, so that the magnetic lines of force are concentrated at an inner diameter end. Therefore, it is possible to delay movement of the magnetic developer leaking out of the magnetic sealing portion to the contact seal member 37, so that the durability of the seal unit 41 can be improved.

<Embodiment 3>

Figure 9:
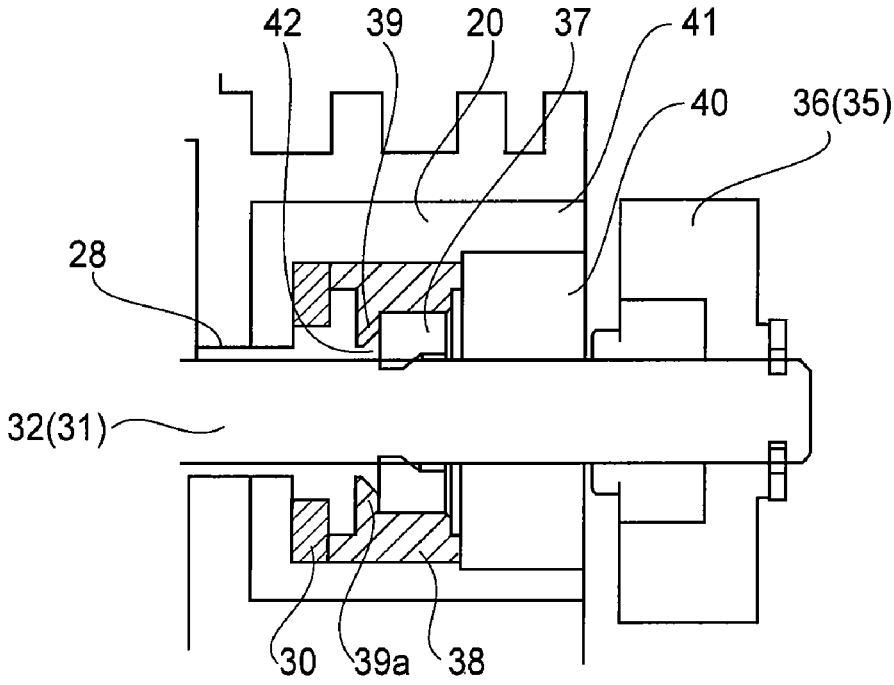

FIG. 9 is an enlarged schematic view of a seal unit 41 in Embodiment 3. A constitution of this embodiment is identical to that of Embodiment 1 except that a cross-sectional shape of the wall portion 39 is changed, thus being omitted from redundant description. In this embodiment, an inner diameter 39*a* of the wall portion 39 is configured to be gradually increased from an inner portion to an outer portion of the housing 33. As a result, compared with the constitution of Embodiment 1, a buffer space 42 is newly formed in the neighborhood of the lip portion of the contact seal member 37. Therefore, even in the case where the developer leaking out of the magnetic sealing portion reaches the lip portion of the contact seal member 37, there is the space for storing the developer in the neighborhood of the lip portion, so that the pressure exerted on the lip portion can be reduced and thus it is possible to improve the durability of the contact seal member 37.

<Embodiment 4>

Figure 10:
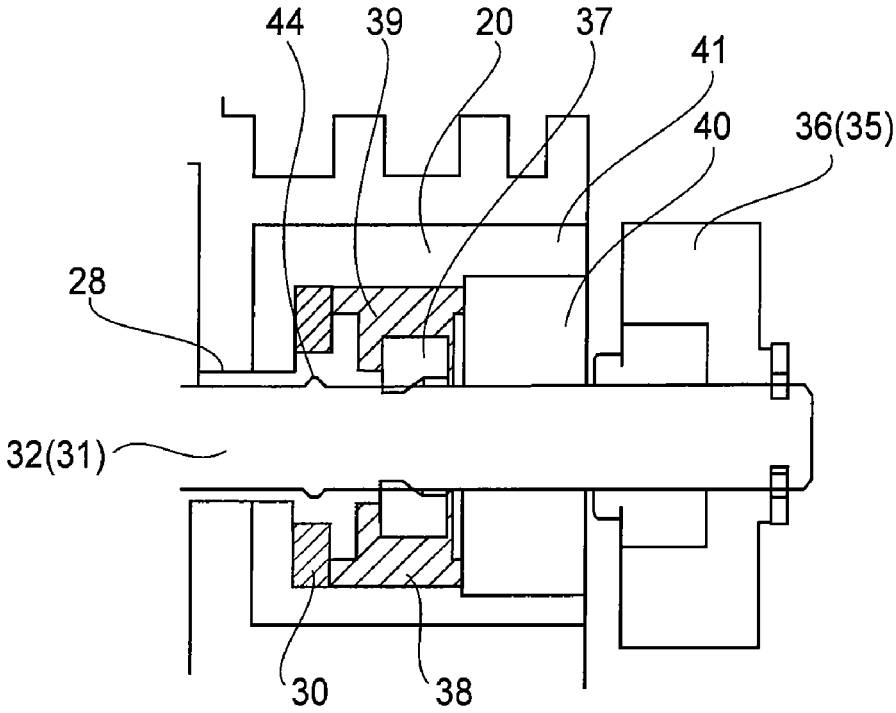

FIG. 10 is an enlarged schematic view of a seal unit 41 in Embodiment 4. In this embodiment, an annular (ring-like) projection 44 is provided, oppositely to the ring magnet 30, on the outer peripheral surface of the core metal of each of the first and second developer stirring members 31 and 32. A constitution of this embodiment is identical to that of Embodiment 1 except that the annular projection 44 is provided, thus being omitted from redundant description. The annular projection 44 is fixed integrally with the core metal. The annular projection 44 may be formed as a part of the core metal by cutting or may also be prepared by separately forming the annular projection 44 and then connecting the annular projection 44 integrally with the core metal by means of bonding or the like. The annular projection 44 is formed with the magnetic member formed of SPCC, SECC, or the like. A height of the annular projection 44 is required to be lower than the inner peripheral surface position of the ring magnet 30. In this embodiment, the inner diameter of the ring magnet 30 is 8.0 mm, whereas an outer diameter of the annular projection 44 at its outer end is 4.8 mm. By the constitution as described above, the magnetic lines of force are concentrated at the gap between the inner peripheral surface of the ring magnet 30 and the annular projection 44, so that the developer collected at the inner peripheral surface of the ring magnet 30 can be prevented from spreading toward the contact seal member 37. Therefore, the pressure applied from the developer to the lip portion of the contact seal member 37 can be further reduced and thus it becomes possible to improve the durability of the contact seal member 37.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 301213/2008 filed Nov. 26, 2008, which is hereby incorporated by reference.

What is claimed is:

1. A developing device for developing with a developer a latent image formed on an image bearing member, said developing device comprising:

a container for containing the developer;

a stirring member, rotatably supported by said container, for stirring the developer in said container;

a magnetic member for forming a magnetic field in a gap between said container and a rotation shaft located at an end portion of said stirring member so as to magnetically confine magnetic particles in the gap;

a seal member, provided outside said magnetic member with respect to a rotation shaft direction of said stirring member, contacting a peripheral surface of the rotation shaft of said stirring member; and a non-magnetic preventing portion, provided between said magnetic member and said seal member, for preventing the magnetic particles confined by said magnetic member from spreading toward said seal member.

2. A device according to claim 1, wherein with respect to a radial direction of the rotation shaft of said stirring member, a gap between said preventing portion and the rotation shaft of said stirring member is narrower than a gap between said magnetic member and the rotation shaft of said stirring member.

3. A device according to claim 1, wherein with respect to the rotation shaft of said stirring member, a space in which the developer confined by said magnetic member is accommodatable is provided between said magnetic member and said preventing portion.

4. A device according to claim 1, wherein said preventing portion is integrally formed with a holder for holding said seal member.

5. A device according to claim 1, wherein said preventing portion is provided to said container and is a wall portion projected toward the rotation shaft of said stirring member.

6. A device according to claim 5, wherein a gap between the wall portion and said stirring member is gradually increased toward said seal member.

7. A device according to claim 1, further comprising a unit for integrally holding said magnetic member, said preventing portion, and said seal member.

8. A process cartridge detachably mountable to an image forming apparatus, comprising:

a developing device according to any one of claims 1 to 7.

* * * * *